US007802327B1

(12) United States Patent
Moceri et al.

(10) Patent No.: US 7,802,327 B1
(45) Date of Patent: Sep. 28, 2010

(54) PORTABLE TRAINING SINK AND VANITY FOR CHILDREN

(76) Inventors: Judith Moceri, 712 Sandor Ct., Paramus, NJ (US) 07652; Michael Moceri, 712 Sandor Ct., Paramus, NJ (US) 07652

( * ) Notice: Subject to any disclaimer, the term of this patent is extended or adjusted under 35 U.S.C. 154(b) by 1000 days.

(21) Appl. No.: 11/497,007

(22) Filed: Aug. 1, 2006

(51) Int. Cl.
*A47K 1/00* (2006.01)

(52) U.S. Cl. ..... 4/625; 4/619; 4/658; 4/631

(58) Field of Classification Search ..... 4/619, 4/625, 658, 635, 631
See application file for complete search history.

(56) References Cited

U.S. PATENT DOCUMENTS

| | | | | | |
|---|---|---|---|---|---|
| 196,034 | A | * | 10/1877 | Nichols | 312/198 |
| 270,479 | A | * | 1/1883 | Milligan | 142/16 |
| 272,467 | A | * | 2/1883 | Penney | 312/227 |
| 361,585 | A | * | 4/1887 | Graf | 4/625 |
| 374,822 | A | * | 12/1887 | Braunfeld | 4/625 |
| 413,200 | A | * | 10/1889 | Milligan | 4/627 |
| 2,539,463 | A | * | 1/1951 | Norquist | 108/27 |
| D250,595 | S | | 12/1978 | Tebbe et al. | |
| 4,747,169 | A | | 5/1988 | Valbuena | |
| 5,165,456 | A | * | 11/1992 | Woolman | 141/98 |
| 5,182,822 | A | | 2/1993 | Cyr et al. | |
| D367,105 | S | | 2/1996 | Goertz | |
| 5,522,411 | A | * | 6/1996 | Johnson | 134/95.2 |
| 5,687,434 | A | | 11/1997 | Tagg | |
| 5,704,078 | A | | 1/1998 | Chandler | |
| 5,822,804 | A | | 10/1998 | Hauflaire | |
| 5,881,404 | A | | 3/1999 | Knight | |
| D409,732 | S | | 5/1999 | Maddux et al. | |
| 6,037,871 | A | | 3/2000 | Babylon | |
| 6,161,228 | A | * | 12/2000 | Wietecha | 4/625 |
| 6,427,259 | B1 | | 8/2002 | Cawthon | |
| D489,155 | S | | 4/2004 | Underbrink | |
| 6,959,460 | B2 | | 11/2005 | Patterson | |
| 6,964,595 | B2 | | 11/2005 | Libretti | |
| 2004/0237188 | A1 | * | 12/2004 | Marcellus | 4/625 |
| 2005/0227581 | A1 | | 10/2005 | Libretti | |

* cited by examiner

*Primary Examiner*—Gregory L Huson
*Assistant Examiner*—Karen Younkins
(74) *Attorney, Agent, or Firm*—Pryor Cashman LLP; Andrew S. Langsam

(57) ABSTRACT

A portable and compact children's training sink is provided with a main housing having a basin, a drain hole disposed in the basin, and a back splash panel substantially adjacent to, behind, and projecting above the basin. Support legs support the main housing, including at least one front support leg and at least one rear support leg. The front and rear support legs are spaced apart to accommodate and placed over or outside of a household bathtub or shower stall. A reservoir is preferably removably disposed in the back splash panel, and a spigot is in fluid communication with the reservoir and extends over and empties into the basin. When the rear support leg is placed inside a bathtub or shower and the front support leg is placed outside the shower, fluid entering the basin by gravity from the reservoir and through the openable spigot exits via the drain hole and empties into the bathtub or shower or a waste water receptacle.

15 Claims, 6 Drawing Sheets

48
26
40
30
23C
23D
46
35
34
32
23E
24

42
44
46
26
23C
23E
20
22
25

54
28R
400
D
28F

PORTABLE TRAINING SINK AND VANITY FOR CHILDREN

BACKGROUND OF THE INVENTION

1. Field of the Invention

The invention is related to hygiene training devices for children, and more specifically to a child-sized sink and vanity which is useful in an existing bathroom or other remote location without formal plumbing connections.

2. Description of Related Art

Teaching children proper hygiene is a part of parenting that begins early in a child's life. Often a child who is capable of learning how to wash her hands is too small even to reach the counter top of the conventional sink let alone reach the faucet and turn the handles of the sink. Typically, one must provide a stool upon which the child may stand or, if close enough to the sink, the toilet seat may serve as a stool for the child. However, it is not optimally safe for a child to be climbing up and down on stools or toilet seats in the bathroom, as the floor is typically tile or stone and the surfaces of the stool, seat, or floor may easily become wet and slippery. As such, the child can easily fall off any of these surfaces. Additionally, it may be difficult for caregivers or babysitters to lift a child to adult sink level.

Previous attempts to enable children to use sinks have been overly complicated. For example, U.S. Pat. No. 5,182,822 to Cyr et al. describes a child's sink with a cabinet housing a water supply that is manually pumped from a below-located reservoir up to the spigot for use in washing. The user (a child) must pump up and down on a vertical handle to force water to flow. This teaches little in terms of the use of most sinks, as, today, water flow is not controlled in adult sinks by pumping of the faucet handles. Also, it is unclear how a child may be pumping the water with one or both hands while trying to properly wash said hands. At any rate, this apparatus very poorly simulates how a real sink works.

Other portable sinks such as those described in U.S. Pat. No. 5,881,404 to Knight and U.S. Pat. No. 6,427,259 to Cawthon are flawed in that they require an actual plumbing connection for a water source and a drain to function, thereby limiting ease of portability. Additionally, they are not designed for children. One hygiene training system that is designed for children is described in U.S. Pat. No. 6,037,871 to Babylon, but it requires an existing fixed toilet, sink, and the above-mentioned undesirable stool to stand upon. It is thus not easily portable, does not address the safety concerns raised above and serves mainly as a teaching tool to be added to a conventional bathroom.

There is thus a long-felt need in the art to provide a portable sink for use by children to get them to appreciate and learn personal hygiene and cleanliness without requiring a special pipe or drainage hookup and which may be portable and readily used remotely or in even the smallest of settings.

SUMMARY OF THE INVENTION

The invention is a portable compact children's training sink. The main housing has a basin, a drain hole disposed in the basin, and a back splash panel substantially adjacent to and projecting above the basin. Support legs support the main housing, including at least one front support leg and at least one rear support leg. Preferably, two or more front and rear support legs are provided. The front and rear support legs are preferably spaced apart to accommodate the width or thickness of a wall of a household bathtub or shower stall, and the width of the main housing is preferably dimensioned to be less than the width of a sliding shower door.

A reservoir is disposable in the back splash panel, and a spigot in fluid communication with the reservoir extends over, provides selective running water and empties into the basin. The spigot is selectively openable and closable to allow fluid in the reservoir to flow out of the spigot and into the basin. Fluid entering the basin exits the basin via the drain hole. There, the "used" water either drains (see below) or is collected for disposal. The reservoir is preferably removable from the back splash panel for ease of filling. When the rear support legs are placed inside a bathtub or shower and the front support legs are placed outside the bathtub or shower, fluid entering the basin exits via the drain hole (and an optional flexible tube extension) and empties directly into the bathtub, shower or even into the toilet.

Optionally, the inventive portable compact children's training sink includes a waste water receptacle in fluid communication with the drain hole, wherein fluid exiting the basin via the drain hole is collected in the receptacle. The receptacle is preferably removable from the main housing for emptying and cleaning. The height of the front and rear support legs may optionally be adjustable.

The main housing of the inventive children's sink preferably also includes a vanity having at least one of the following: mirror, toothbrush holder, soap receptacle, tissue holder, or towel holder. The vanity may further include a counter top sloped toward the basin.

A locking mechanism is preferably provided to retain the reservoir in the back splash panel at the discretion of the (adult) user. This aids the adult in moving the entire device and adds overall stability thereto. The locking mechanism may include a retaining pin passing through a first bore in the back splash panel and a second bore in the reservoir. Alternatively, the retaining pin may have an enlarged distal end section fittable into a recess formed on the exterior of the reservoir but that does not fit through the narrower and aligned bore of the back splash. In such an embodiment, the retaining pin is permanently secured to the back splash and it cannot be fully withdrawn and subsequently misplaced. For either version of the retaining pin, the proximal end of the retaining pin preferably terminates in a toothbrush holder or similar hygiene device. Instead of or in addition to the retaining pin, the locking mechanism may further include a retaining case hingedly attached to the back splash panel, the retaining case including latches to secure the retaining case around the reservoir and to the back splash panel. A retaining frame or case is hingedly attached to the back splash panel, the retaining frame or case including latches to secure the retaining frame around the reservoir and to the back splash panel.

DETAILED DESCRIPTION OF THE PREFERRED EMBODIMENTS AND DRAWINGS

Description will now be given of the invention with reference to the attached FIGS. 1-5. It should be understood that these figures are exemplary in nature and in no way serve to limit the scope of the invention which is defined by the claims appearing hereinbelow.

Figure 6:
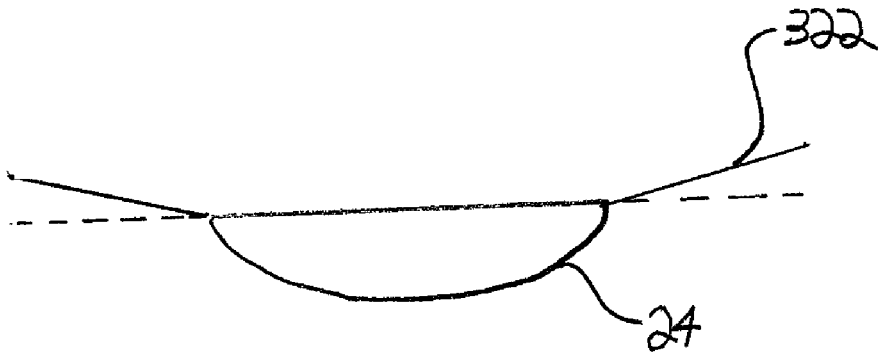
FIG. 6 is a front sectional schematic of an angled counter top in accordance with the invention.

The inventive children's sink 10 includes as its primary components main housing 20, reservoir 40, and waste water receptacle 50. Main housing 20 includes counter top 22 in which is molded or disposed a sink or wash basin 24 having a central drain hole 25. Counter top 22 may be angled slightly inwardly and downwardly towards basin 24 so that water which splashes thereon will tend to drain into the basin (see, e.g., angled counter top 322 in section in FIGS. 3 and 6). Projecting upward from and behind counter top 22 are substantially vertical supports 26. Beneath and/or integral with supports 26 is disposed a back splash panel 30 on which is mounted spigot 32 having a handle 34. Spigot 32 extends over basin 24 so that water coming out of spigot 32 falls directly into basin 24. Basically, the spigot is preferably aligned with drain 25, too. Of course, control of the spigot can be accomplished by two handles, like an adult hot and cold handle.

Main housing 20 is supported by legs 28. As shown in FIG. 2, legs 28 include front legs 28F and rear legs 28R. The front and rear legs are spaced apart by a distance D so that the housing may be placed over the rim of a shower stall or the side wall of a bathtub. When legs 28 are placed on opposite sides of the wall/rim of the bathtub/shower, specifically with the front legs 28F being placed outside the bathtub/shower and the rear legs 28R being placed inside the bathtub/shower, drain hole 25 sits above and empties into the bathtub/shower. The inventive sink 10 thus provides a very space-economical solution to the problem of providing a child's sink, in that only a small portion of the device need occupy any floor space outside the bathtub or shower stall. Placing the device over the wall/rim of the tub/shower also provides drainage of the water into the tub or shower, where it will drain down that device's normal drainage and plumbing. Thus, disposal of the used water is easily accomplished. The training vanity or selected components may be made of waterproof materials such as plastic so that it may remain in the shower or tub when the shower/tub is being used, or it may simply be moved out of the way during a bath or shower. The drain hole need not be located over the inside of the tub or shower but, rather, as an alternative, the drain 25 can be provided with a backwardly and downwardly directed outlet tube which collects the water and diverts it into the shower or tub.

Figure 1:
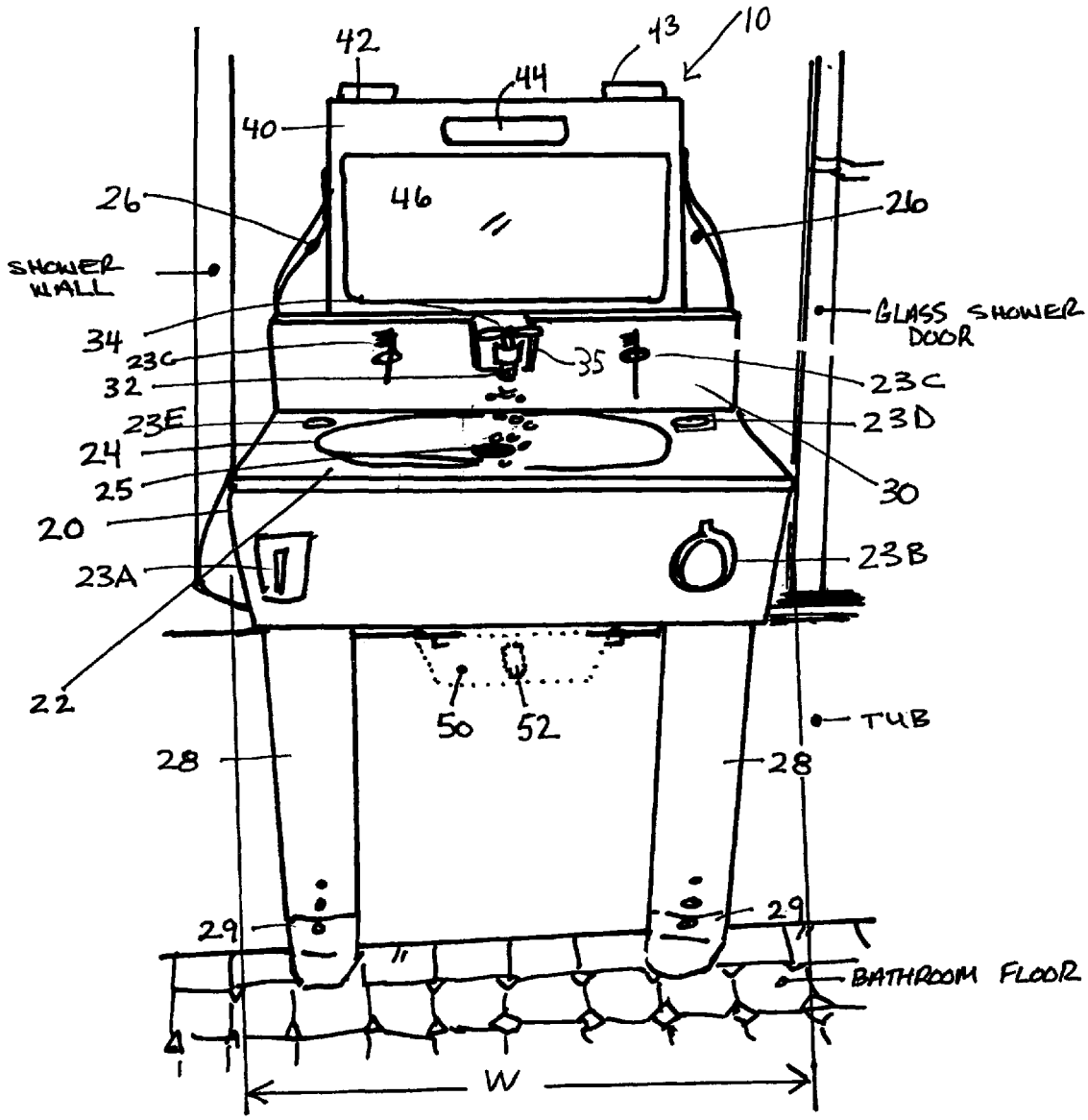
FIG. 1 is a front perspective view of a portable children's training sink, mounted over the side of a bathtub, in accordance with the invention.
Figures 2A, 2B, 2C:
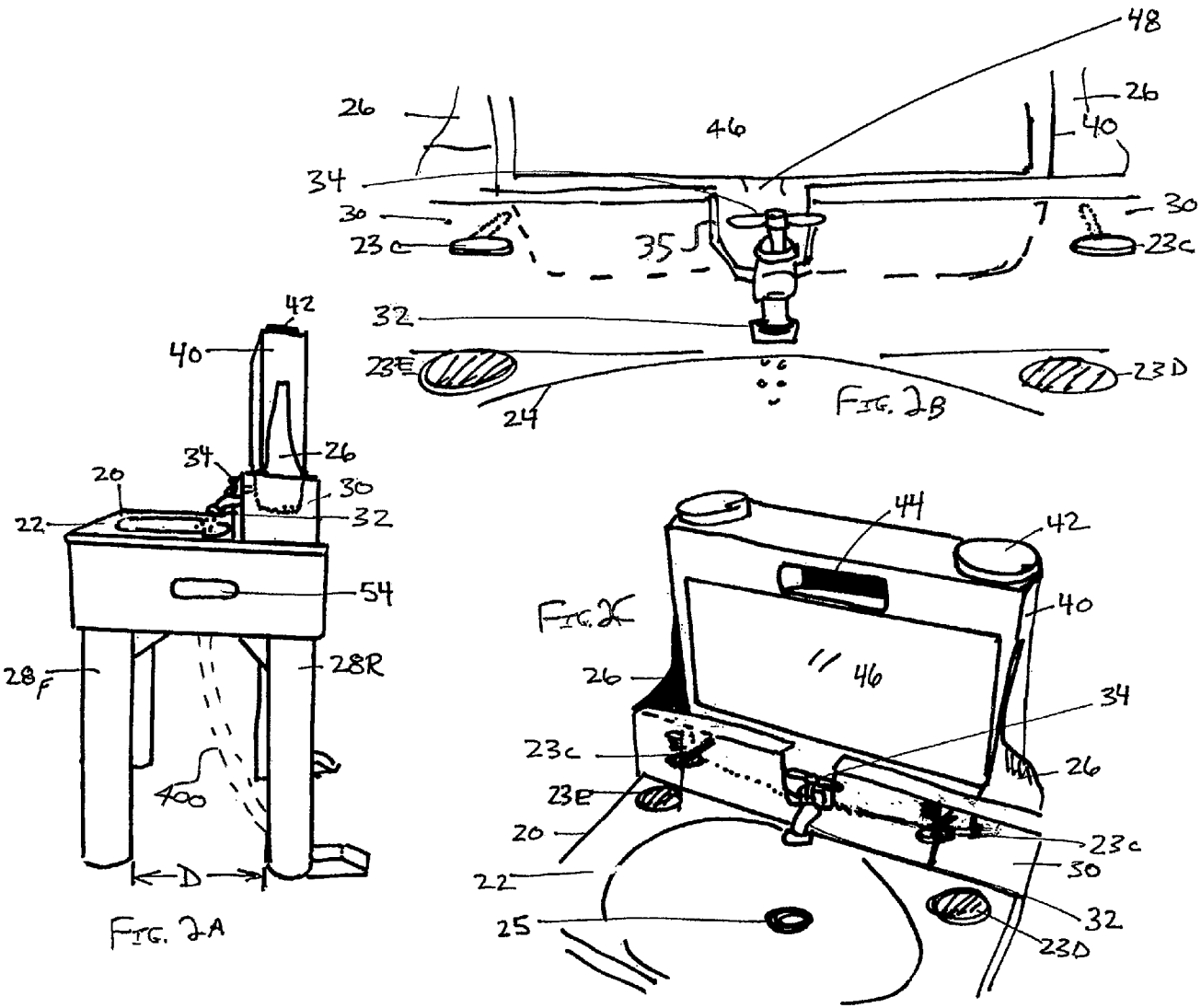
FIG. 2A is a side elevational view of the portable children's training sink of FIG. 1.
FIG. 2B is an enlarged, partial, front perspective view of the faucet, backsplash and basin of an embodiment of the invention.
FIG. 2C is top front perspective view of a portable children's sink in accordance with the invention.

Similarly, as shown in FIG. 1, the width W of the housing 20 is dimensioned to fit within a standard sliding shower door when the door is open (i.e., when one panel is slid to be superimposed over the other panel).

Figure 3:
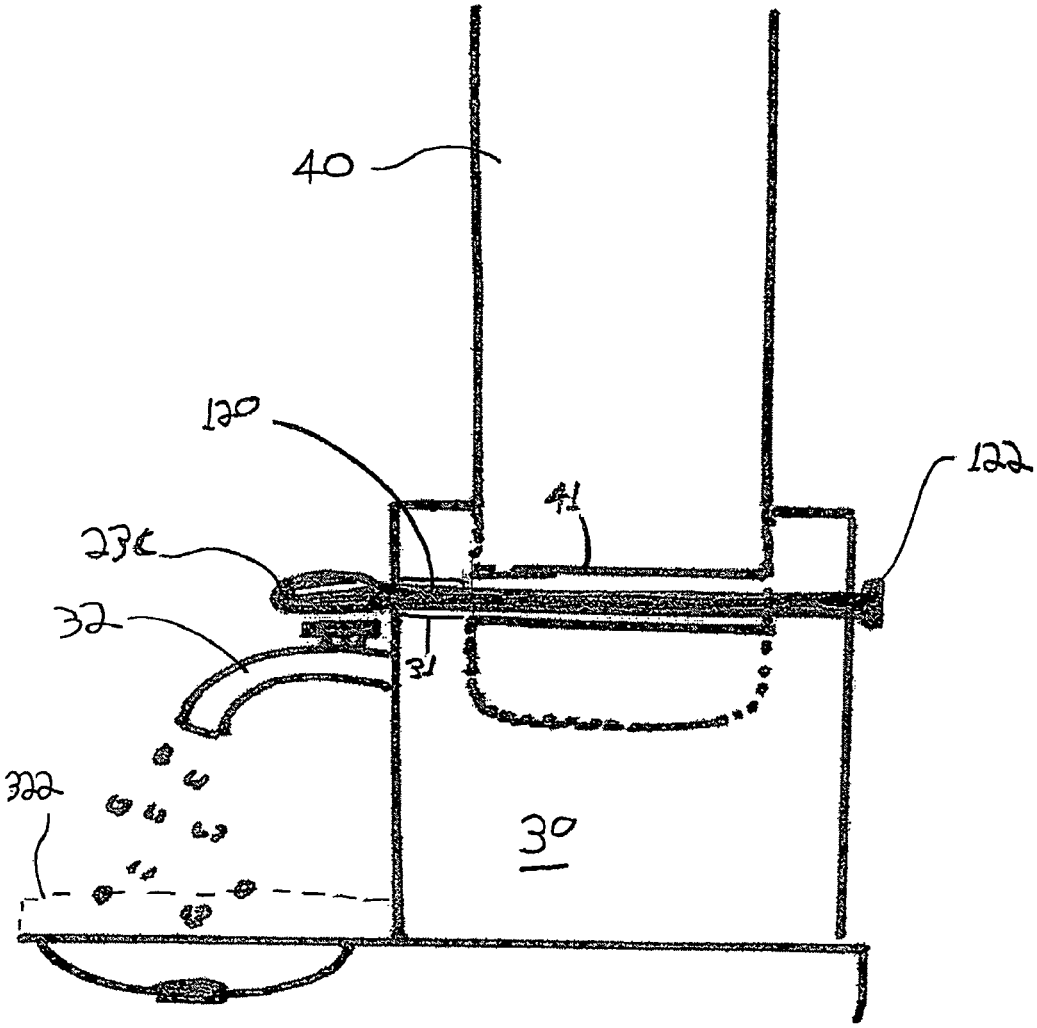
FIG. 3 is a side sectional view of one embodiment of the reservoir retaining mechanism and optional sloped counter top in accordance with the invention.
Figure 4:
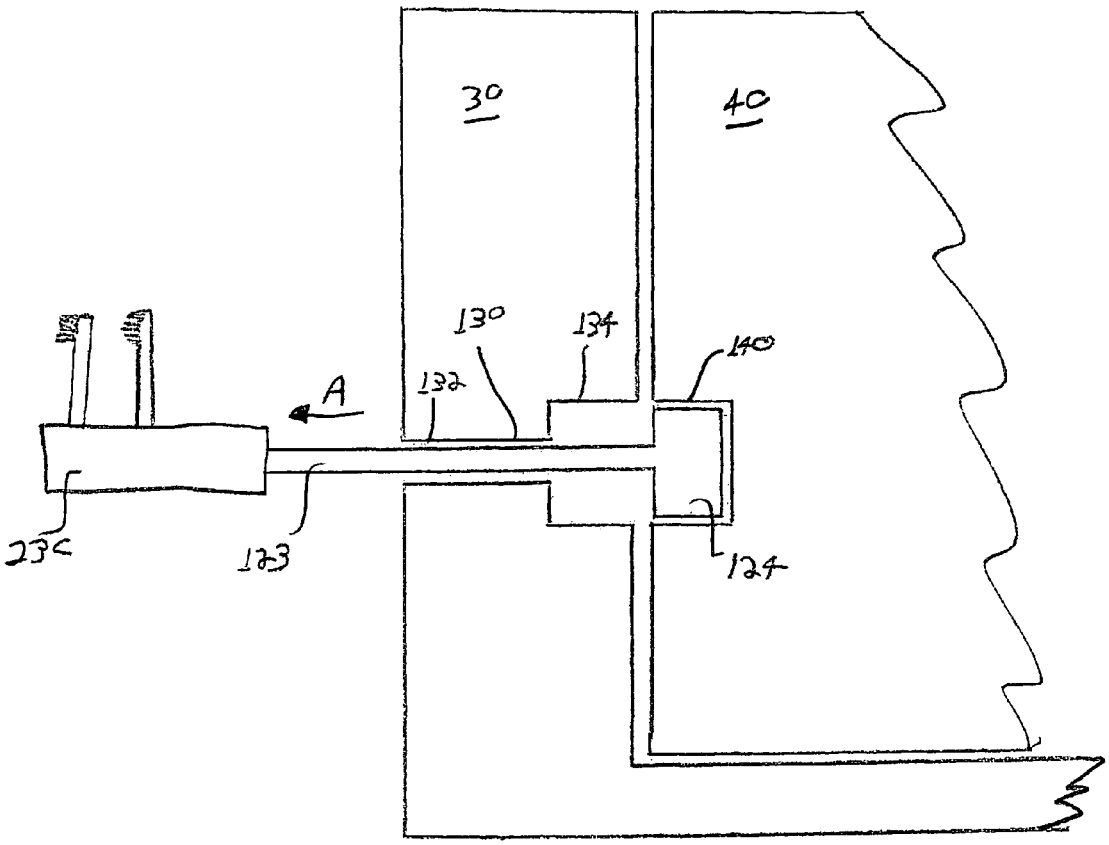
FIG. 4 is an enlarged side sectional view of another embodiment of the reservoir retaining mechanism in accordance with the invention.

Reservoir 40 is preferably retained within back splash 30 with a pair of pins of various configurations shown in FIGS. 3-4. In both figures, the proximal ends of the pins also serve as toothbrush holders 23C. Of course, the retaining pins need not terminate in any other device, functional or otherwise. In any event, as shown in FIG. 3, toothbrush holder 23C is connected to a retaining pin 120 having a screw-off knob 122 at its distal end. As shown, both back splash 30 and reservoir 40 are provided with matching bores 31 and 41, respectively, to accommodate pin 120. When reservoir 40 is placed in back splash 30 and is supported laterally by vertical supports 26, bore 31 is aligned with bore 41, and the retaining pins 120 can pass all the way therethrough. Knob 122 may be provided to secure pin 120 within bores 31 and 41. When thus secured, pins 120 keep reservoir 40 attached to back splash 30, and consequently, the entire device may be picked up and moved by handle 44 in reservoir 40. Alternatively, instead of screw-off knob 122, a collet pin (not shown) may be used to secure retaining pin 120 within bores 31 and 41.

In many cases when dealing with children's devices, it is common for parts to become lost when separated from the main device. This is especially troublesome in a bathroom environment when the small parts in question can easily fall into the toilet or down the bathtub drain. To with, FIG. 4 illustrates an alternative embodiment of the reservoir retaining mechanism which has no removable parts like screw-off knob 122 or a collet pin. In this embodiment, toothbrush holder 23C is attached to pin 123 which has an enlarged retaining plug 124 at its distal end. Back splash 30 is provided with bore 130, having a narrow portion 132 and a wide portion 134. Wide portion 134 is wide enough to receive and accommodate retaining plug 124, but narrow portion 132 is only wide enough to accommodate the narrow portion of pin 123. Reservoir 40 is provided with a recess 140 which is dimensioned similarly to that of the wide portion 134 of back splash bore 130; that is, it can accommodate and retain retaining plug 124, preferably snugly and securely. The depth of wide portion 134 and recess 140 is adequate to fully hold retaining plug 124. When it is desired to remove reservoir 40 from back splash 30, the user pulls on toothbrush holder 23C in the direction of arrow A in FIG. 4. Retaining plug 124 is pulled out of recess 140 and is pulled into and retained in wide portion 134 of bore 130, and the reservoir is free to be removed, yet the toothbrush holder 23C and pin 123 remain attached to back splash 30 and can not be misplaced.

Figure 5B:
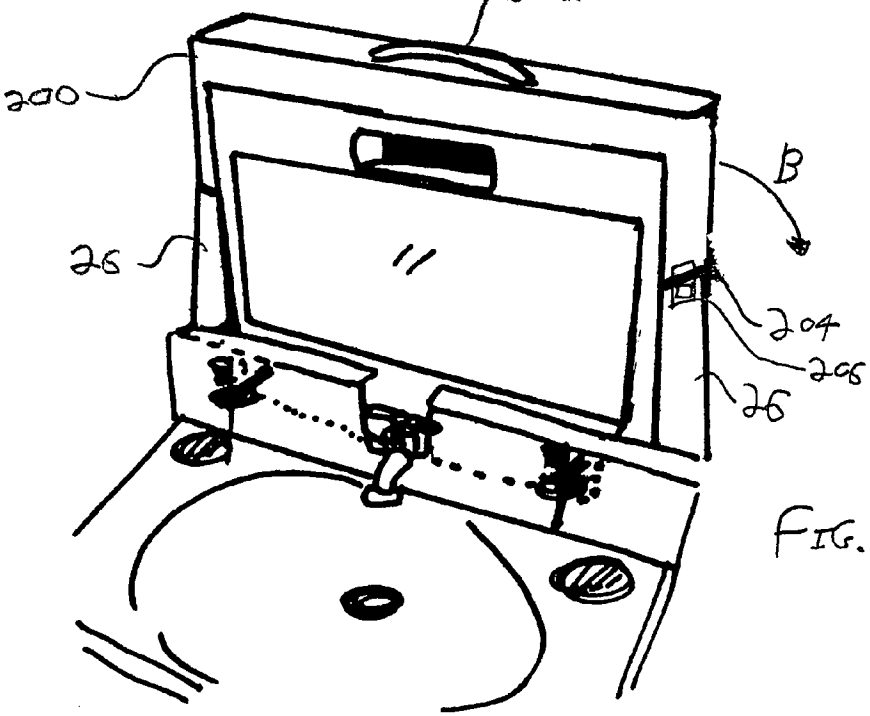
FIG. 5B is a top front perspective view of the portable children's sink of FIG. 5A.
Figure 5A:
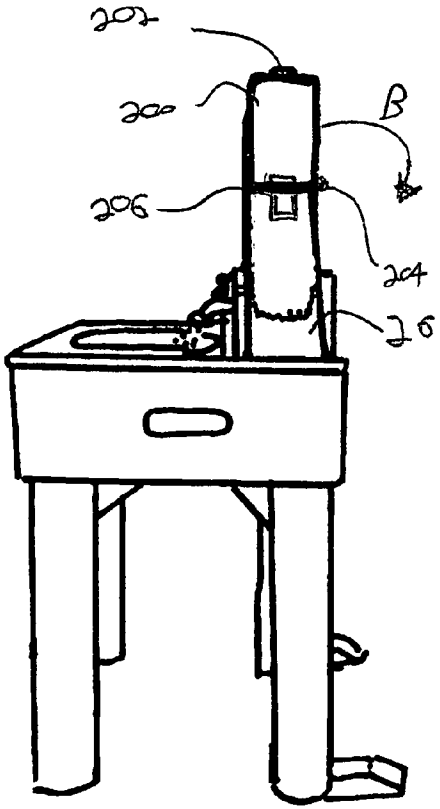
FIG. 5A is a side elevational view of another embodiment of a portable children's training sink in accordance with the invention.

Another embodiment of the invention is shown in FIGS. 5A-B having a different reservoir retaining mechanism. Attached to the top of vertical supports 26 or otherwise to back splash 30 is a frame 200 having handle 202. Frame 200 is preferably hingedly attached to supports 26 by hinge 204 and openable in the direction of arrow B as shown in FIGS. 5A-B. Preferably, frame 200 is also lockable to vertical supports 26, e.g., by latches 206 or other known locking means. Once the reservoir is inserted into its slot, frame 200 is closed and secured to supports 26, thereby securing reservoir 40 to the sink and allowing the entire unit to be lifted and carried by handle 202. The retaining frame or case 200 is hingedly attached to the back splash panel 30, the retaining frame including latches 206 to secure the retaining frame around the reservoir 40 and to the back splash panel 30.

The reservoir retaining mechanism, whatever its form, assists the parent or guardian in moving the sink 10 with the reservoir via reservoir handle 44 without fear of the reservoir falling out (whether full or not) and also keeps reservoir 40 attached to sink 10 even in the event a child 'plays rough' with sink 10. In any event, the retaining mechanism adds to the overall stability and integrity of sink 10. It can, of course, be selective unlocked (in a preferably child-proof manner) by an adult when it is desired to separate the reservoir from the supports for filling and cleaning.

Because children often grow taller very quickly, legs 28 may be made adjustable in height in a number of different ways. In one embodiment, legs 28 terminate in stackable feet 29. As the child grows taller, more feet 29 may be added and secured to the bottom of legs 28 so as to raise the level of counter top 22. Alternatively or in addition, legs 28 may be made with several telescoping members with the appropriate locking mechanisms. The telescoping leg embodiment may be advantageous for a household with multiple children in that the leg height is more easily adjustable between uses.

Housing 20 may include a vanity that has one or more ancillary devices 23 for aiding in personal hygiene as may be found in a typical vanity or adult bathroom sink area, for example, tissue holder 23A, towel ring 23B, toothbrush holder 23C (either as retaining pins or not), recessed soap dish 23D, or cup and cup receptacle 23E. Any other typical vanity elements may be included.

Disposed between supports 26 of housing 20 is a box-like reservoir 40, the source of water for training sink 10. Reservoir 40 slidingly fits between flanges of supports 26 and rests a few inches deep inside back splash 30. It is preferably, though not necessarily, vertically removable for easy filling. Reservoir 40 is substantially hollow and includes one or more fill holes 42 with caps 43 for adding water to the reservoir. Recessed handle 44 is optionally molded into the reservoir to facilitate removal and replacement of the reservoir for filling and cleaning. Handle 44 is also useful for lifting and moving the entire sink when reservoir 40 is securely attached to the main housing 20. As shown in FIG. 1, the front face of reservoir 40 includes non-glass-based a minor or reflective surface 46; as an alternative, back splash panel 30 may instead extend upward in between supports 26 and in front of reservoir 40, mirror 46 may be disposed on this taller back splash panel 30 rather than on the reservoir itself. In any case, reservoir 40 also includes a drain hole 48 which is registerable above the entry to spigot 32 when reservoir 40 is placed in its slot between supports 26. The precise mechanism of how fluid egresses from drain hole 48 into spigot 32 is one of rudimentary and conventional plumbing. As an alternative, spigot 32 may be integral and sealed fluid-tight with reservoir 40; in such an embodiment, back splash panel 30 is provided with a slot 35 (see FIGS. 1 and 2B) to accommodate the spigot of the reservoir. The drain hole 48 can, if desired, be the sole mechanism for introducing water into the reservoir. Alternatively, a length of hose and funnel can be provided as accessories and housed within but selectively removal from the interior of the reservoir to allow the parent to refill the reservoir without removing the same from the supports. When refilling is needed, the funnel and attached hose is withdrawn from the reservoir and the funnel attached to a source of water, preferably, a permanently installed spigot of an adult sink.

A waste water receptacle 50 may also be provided beneath basin 24. Specifically, waste water receptacle or drawer 50 is in fluid communication with drain 25 so that water entering basin 24 leaves via drain hole 25 and is collected in waste water receptacle 50. Handle 52 is provided to facilitate removal, emptying, and replacement of waste water receptacle 50. The waste water receptacle slides in and out, beneath the basin, on laterally spaced drawer slides.

Drain hole 25 is preferably positioned so that when the sink is in position over the outside wall of a shower stall or bathtub, the drain hole is over the inside of the shower/tub portion, and water flowing into drain hole 25 will drain directly from the basin to the shower/tub. As an optional accessory, a flexible tube 400 (see FIG. 2A) may be provided to direct water from the drain hole 25 into the tub or shower or somewhere else. Such tube is preferably removable via known hose connection means such as a "quick-connect" connector or the like.

In operation, the invention works as follows. Reservoir 40 is filled with water or another appropriate fluid via fill hole 42 and is placed in its slot between supports 26, preferably being locked into place with one of the locking mechanisms described above or the like. In either the embodiment having an integral spigot 32 or the embodiment in which drain hole 48 must be aligned with spigot 32 on back splash panel 30, reservoir 40 is now available for use as a source of water for the child. When the child needs to wash her hands, brush her teeth, or perform other basic ablutions, she turns handle 34 on spigot 32 to allow the water in reservoir 40 to flow out of spigot 32 just as in a real "adult" sink (the only difference being that water from reservoir 40 and spigot 32 is gravity-driven). The water falls into basin 24 and drains therefrom via drain hole 25. Where the water goes next depends on whether waste water receptacle 50 is in place. If it is in place, waste water is collected therein and periodically emptied. If the waste water receptacle is not in place, and the housing is placed over the outside wall of a shower stall or bathtub as explained above (i.e., with the front legs 28F outside the tub/stall and the rear legs 28R inside the tub/stall) water flows from drain hole 25 and into the tub/stall and drains out via the tub/shower drain. As mentioned the basin can also be provided with a flexible hose for draining water into the tub, shower or even into another bottle, container, or even a toilet.

By providing a small, adjustable sink for children, children need not stand on top of counter tops, stools or toilet seats to reach a sink and, yet, they are able to wash themselves comfortably and learn about personal hygiene. Cleanup of the inventive sink is easier than having to clean up the adult sink after a child has used it, especially since counter top 22 may be provided with an inwardly and downwardly directed incline to cause water thereon to drain into basin 24. Also, children using the invention learn another valuable lesson: that of water conservation. The amount of water in reservoir 40 is finite; therefore, leaving the water running unnecessarily causes the water supply to run out more quickly. This instills in the child proper conservationist behavior conducive to turning off the water when it is not required (e.g., while brushing her teeth), which is likely to be transferred to the child's adult behavior later in life. Water conservation is further taught by the device by enabling the child user to see how much water she uses (especially if the reservoir is transparent or translucent) and thus how much water she can save in washing up.

Having described the invention with respect to the above embodiments and drawings, it should be noted that the scope of the invention is not limited to the above description or what is shown in the drawings but rather is defined by the claims appearing hereinbelow and all such equivalents.

What is claimed is:

1. A portable and compact children's training sink, comprising:

a main housing having a basin, a drain hole disposed in said basin, and a back splash panel substantially adjacent to and projecting above said basin, said basin being sloped towards said drain hole;

support legs supporting said main housing, including at least one front support leg and at least one rear support leg, said front and rear support legs being spaced just enough apart to accommodate the width of a wall of a household bathtub or shower stall;

a fluid reservoir selectively disposable in and removable from said back splash panel which is waterproof and due to its lightweight nature can be easily moved when empty; and a spigot in fluid communication with said reservoir and extending over and emptying into said basin, and wherein when said rear support leg is placed inside a bathtub or shower and said front support leg is placed outside a bathtub or shower, fluid entering said basin exits via said drain hole and into the bathtub or shower.

2. A portable and compact children's training sink according to claim 1, said spigot being selectively openable and closable to allow fluid in said reservoir to flow out of said spigot and into said basin.

3. A portable and compact children's training sink according to claim 2, further comprising a selectively removable waste water receptacle in fluid communication with said drain hole, wherein fluid exiting said basin via said drain hole is collected in said waste water receptacle.

4. A portable and compact children's training sink according to claim 1, wherein said reservoir is removable from said back splash panel.

5. A portable and compact children's training sink according to claim 1, wherein the height of said front and rear support legs is adjustable.

6. A portable and compact children's training sink according to claim 1, said main housing further comprising a vanity.

7. A portable and compact children's training sink according to claim 6, said vanity having at least one of the following: a mirror; toothbrush holder; soap receptacle; tissue holder; or towel holder.

8. A portable and compact children's training sink according to claim 6, said vanity further comprising a counter top sloped downwardly and inwardly toward said basin.

9. A portable and compact children's training sink according to claim 1, further comprising a flexible tube in fluid communication with said drain hole, wherein fluid entering said drain hole is conducted away from said basin via said tube.

10. A portable and compact children's training sink according to claim 1, further comprising a locking mechanism selectively retaining said reservoir in said back splash panel.

11. A portable and compact children's training sink according to claim 10, said locking mechanism further comprising a retaining pin passing through a first bore in said back splash panel and an aligned second bore in said reservoir.

12. A portable and compact children's training sink according to claim 10, said locking mechanism further comprising a retaining pin having an enlarged distal end section slidingly fittable into a recess formed on the exterior of said reservoir.

13. A portable and compact children's training sink according to claim 12, said proximal end of said retaining pin terminating in a toothbrush holder.

14. A portable and compact children's training sink according to claim 10, said locking mechanism further comprising a retaining frame hingedly attached to said back splash panel, said retaining frame including latches to secure said retaining frame around said reservoir and to said back splash panel.

15. A portable and compact children's training sink according to claim 1, wherein a width of said main housing is dimensioned to less than the width of a conventional sliding shower door.

* * * * *